US009174331B1

(12) United States Patent
Coghlan

(10) Patent No.: US 9,174,331 B1
(45) Date of Patent: Nov. 3, 2015

(54) BUSHING REMOVAL TOOL

(71) Applicant: Roper Pump Company, Commerce, GA (US)

(72) Inventor: John Matthew Coghlan, Hoschton, GA (US)

(73) Assignee: Roper Pump Company, Commerce, GA (US)

( * ) Notice: Subject to any disclaimer, the term of this patent is extended or adjusted under 35 U.S.C. 154(b) by 231 days.

(21) Appl. No.: 13/951,751

(22) Filed: Jul. 26, 2013

(51) Int. Cl.
*B25B 27/06* (2006.01)

(52) U.S. Cl.
CPC ..... *B25B 27/062* (2013.01)

(58) Field of Classification Search
CPC ..... Y10T 29/49698; Y10T 29/53848; Y10T 29/53852; Y10T 29/53861; Y10T 29/53865; Y10T 29/53891; B25B 27/062
See application file for complete search history.

(56) References Cited

U.S. PATENT DOCUMENTS

| | | | | |
|---|---|---|---|---|
| 2,305,076 | A | 12/1942 | Graham | |
| 2,618,053 | A | 11/1952 | Claps | |
| 2,646,619 | A | 7/1953 | McCord | |
| 3,611,540 | A * | 10/1971 | Gibu | 29/263 |
| 4,207,664 | A | 6/1980 | Zoula | |
| 4,716,642 | A | 1/1988 | Bill, Sr. et al. | |
| 4,724,608 | A | 2/1988 | Parrott | |
| 5,226,208 | A | 7/1993 | Gracey | |
| 5,333,378 | A | 8/1994 | Sjobom | |
| 6,158,110 | A | 12/2000 | Takacs | |
| 6,212,775 | B1 | 4/2001 | Sarver et al. | |
| 6,671,959 | B1 | 1/2004 | Skaggs | |
| 8,186,031 | B2 * | 5/2012 | Whitney et al. | 29/26 B |
| 8,230,566 | B2 | 7/2012 | Oguri | |

FOREIGN PATENT DOCUMENTS

GB 191324896 A * 0/1914 ..... B25B 27/023

OTHER PUBLICATIONS

International Search Report for corresponding PCT Application No. PCT/US2014/047554 dated Sep. 9, 2014.

* cited by examiner

*Primary Examiner* — David Bryant
*Assistant Examiner* — Amanda Meneghini
(74) *Attorney, Agent, or Firm* — Caesar Rivise, PC

(57) ABSTRACT

Gear pumps use various types of bushings or bearings (sleeves) between a shaft and the housing of the pump. From time to time, these sleeves wear out and have to be replaced. This extractor removes the sleeves and includes three main components—a collet or sleeve engaging member, a mounting bracket, and a lift screw. The extractor may also include other components within the scope of the invention, including melting screws and washers.

9 Claims, 5 Drawing Sheets

BUSHING REMOVAL TOOL

BACKGROUND OF THE INVENTION

1. Field of Invention

This invention relates generally to bushing and bearing pullers, and more particularly to bushing and bearing pullers for extracting bushings and bearings from blind holes.

2. Description of Related Art

Various types of pulling devices have been proposed for removing bushings or bearing from blind holes. Examples of such devices are shown in U.S. Pat. Nos. 2,618,053; 4,207,664; 4,724,608; 6,158,110; and 8,230,566. Each of these devices are either cost prohibitive, time consuming or cause excessive damage to some of the components involved. For example, in U.S. Pat. Nos. 2,618,053, and 4,207,664, removal of a bushing causes excessive damage to the housing from which the bushing is extracted. In U.S. Pat. Nos. 4,724,608; 6,158,110; and 8,230,566, the extractor devices are time consuming as insertion of a member into the bushing and remove of the bushing require torque applied to the device in multiple stages, directions, or onto different parts of the device. The inventors of this invention have designed an improved extractor that can be used with basic shop tools to safely, quickly and efficiently remove a sleeve (e.g., busing, bearing) with minimal damage to components.

All references cited herein are incorporated herein by reference in their entireties.

BRIEF SUMMARY OF THE INVENTION

This summary is provided to introduce a selection of concepts in a simplified form that are further described below in the detailed description. This summary is not intended to identify essential features of the claimed subject matter, nor is it intended for use in determining the scope of the claimed subject matter.

In accordance with an example of the invention, an extractor tool is provided for pulling a sleeve (e.g., bushing, bearing) out of a housing, with the sleeve having a central recess defining a radial surface. The extractor tool includes a mounting bracket, a lift screw, and a sleeve engaging member. The mounting bracket includes a central bridge member with a top face, and integral with the central bridge member a depending member extending from the central bridge member a first distance towards a distal housing engaging surface thereof opposite the top face to contact a surface of the housing outside the sleeve. The housing engaging surface is spaced from the central bridge member to define a sleeve receiving channel within the mounting bracket. The central bridge member has a bore therethrough in alignment with the sleeve receiving channel. The lift screw includes a shaft that is threaded and extendable through the bore in the mounting bracket. The sleeve engaging member is continuous with the threaded shaft, and has a proximal end and a distal end slidingly engageable within the central recess of the sleeve. The sleeve engaging member integrally has an exterior wall and an interior wall. The interior wall is threaded therein with a thread sized complimentary to the threaded shaft of the lift screw. The interior wall has a tapered shape with a diameter smaller at the distal end of the sleeve engaging member than at a proximal end thereof. The distal end includes a grasping portion with a plurality of longitudinal slots dividing the grasping portion into a plurality of grasping members. Each grasping member is radially expandable upon the rotation of the threaded shaft towards the distal end to cause the exterior wall to engage the radial surface of the sleeve. The lift screw is rotatable in a first direction to engage the sleeve engaging member, to cause the exterior wall of the sleeve engaging member to radially expand and grip the radial surface of the sleeve, and to pull the sleeve out of the housing.

In accordance with another example of the invention, a method for pulling a bearing or bushing sleeve out of a housing with an extractor tool is described. In this example, the sleeve has a central recess defining a radial surface. The extractor tool includes a mounting bracket, a lift screw, and a sleeve engagement member. The mounting bracket has a central bridge member with a top face and a depending member integral with the central bridge member and extending therefrom a first distance towards a distal housing engaging surface thereof opposite the top face to contact a surface of the housing outside the sleeve. The housing engaging surface is spaced from the central bridge member to define a sleeve receiving channel within the mounting bracket. The central bridge member has a bore therethrough in alignment with the sleeve receiving channel. The lift screw includes a threaded shaft extending through the bore in the mounting bracket. The sleeve engaging member is continuous with the threaded shaft, and has a proximal end and a distal end slidingly engageable within the central recess of the sleeve. The sleeve engaging member has an exterior wall and an interior wall with the interior wall threaded therein with a thread size complimentary to the threaded shaft of the lift screw. The interior wall has a tapered shape with a diameter small toward the distal end of the sleeve engaging member. The distal end includes a grasping portion with a plurality of longitudinal slots dividing the grasping portion into a plurality of grasping members. Each grasping member is radially expandable upon the rotation of the threaded shaft towards the distal end to cause the exterior wall to engage the radial surface of the sleeve. The exemplary method for pulling the sleeve out of the housing includes engaging the sleeve engaging member about the lift screw by rotating the threaded shaft in a first arcuate direction relative to the sleeve engaging member and into the interior wall of the sleeve engaging member, inserting the sleeve engaging member into the central recess of the sleeve, radially expanding the grasping members into gripping engagement with the radial surface of the sleeve by further rotating the threaded shaft in the first arcuate direction, and pulling the sleeve out of the housing by still further rotating the threaded shaft in the first arcuate direction.

Further scope of applicability of the present invention will be apparent from the detailed description set forth hereinafter. However, it should be understood that the detailed description and specific examples, while indicating preferred embodiments of the invention, are given by way of illustration only, and that the invention is not limited to the precise arrangements and instrumentalities shown, since the invention will become apparent to those skill in the art from this detailed description.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

The present invention will be illustrated in more detail with reference to the accompanying drawings, and which preferred embodiments of the invention are shown. This invention may, however, be embodied in many different forms and should not be construed as limited to the embodiments set forth below. Rather, these exemplary embodiments are provided so that this disclosure will be thorough and complete, and will fully convey the scope of the invention to those skilled in the art.

The examples of the present invention include bearing or bushing removal tools used, for example, with gear pumps. Gear pumps typically use various types of bushings between their shaft and housing. From time to time, these bushings wear out and have to be replaced. The removal or extractor tool described in greater detail below removes these bushings from gear pumps. While not being limited to a particular theory, the preferred extractor tool described herein by example includes three primary components, a mounting bracket, a lift screw, and a collet. The extractor tool may also include mounting screws and washers typically adjacent the screws. The exemplary mounting bracket discussed below may be held in place against a housing holding a bushing by, for example, at least two screws and washers. The collet is inserted into the bushing until its outer surface, which may include tabs or other grabbing member, engages the bushing. The lift screw may be inserted through protecting washers and through a bore in the mounting bracket, and threaded into the collet. Continued threading of the lift screw expands the collet against the bearing or bushing sleeve. Thereafter, continued torque on the lift screw forces the collet up, which in turn pulls the sleeve up and out of the housing.

Figure 1:
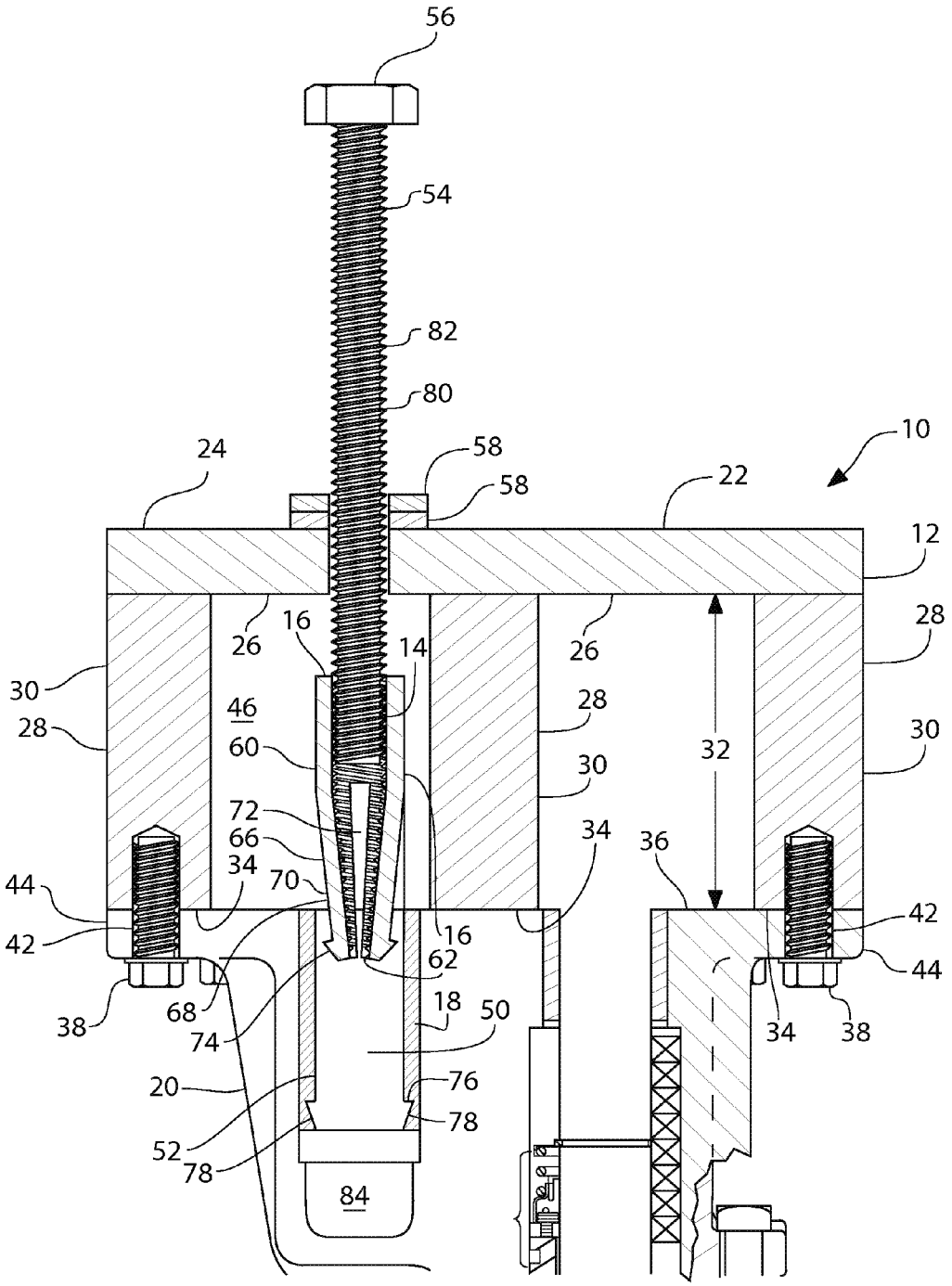
FIG. 1 is a side view of an exemplary extractor tool in accordance with the embodiments of the invention.
Figure 2:
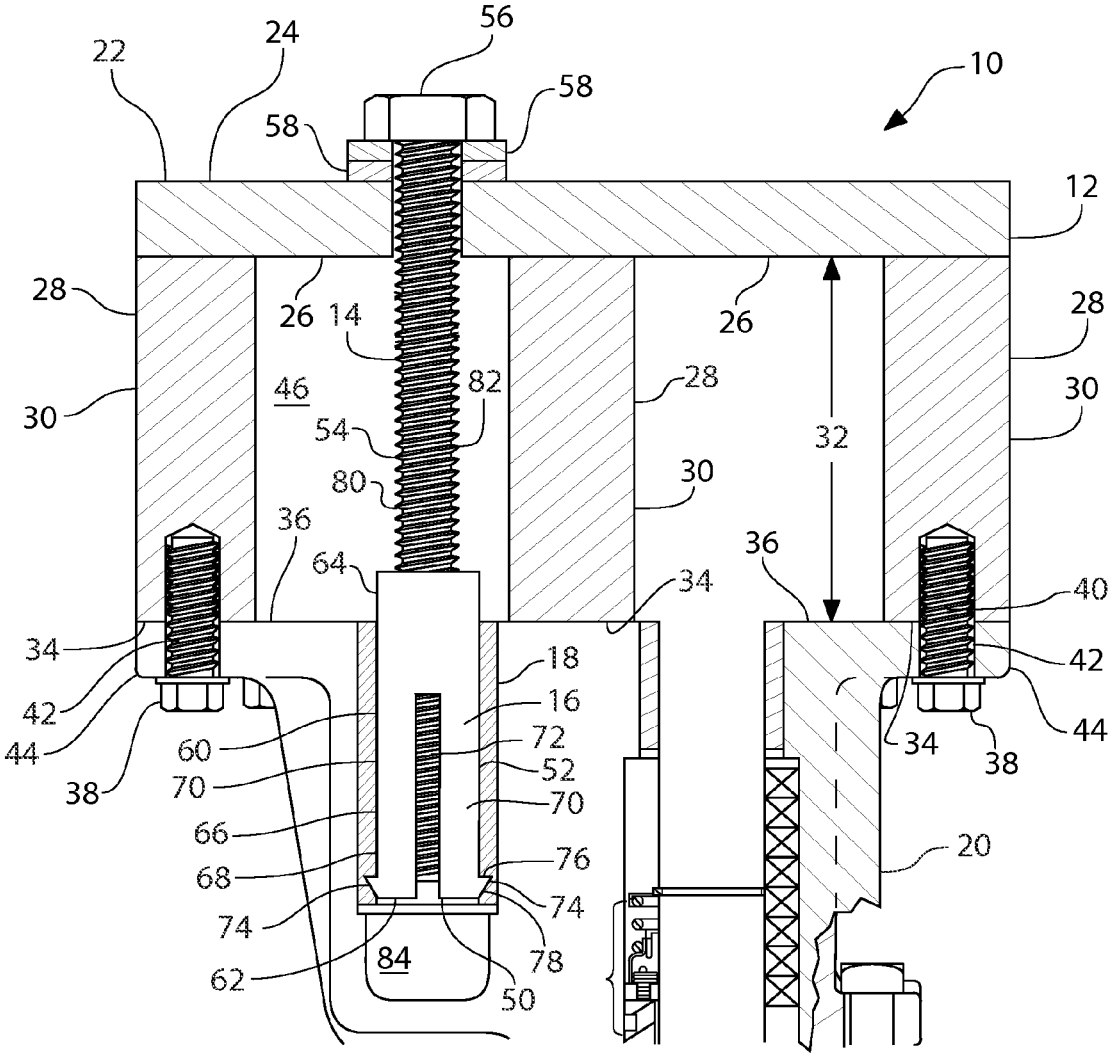
FIG. 2 is a side sectional view of the extractor tool of FIG. 1 prior to removal of a bearing or bushing sleeve.
Figure 3:
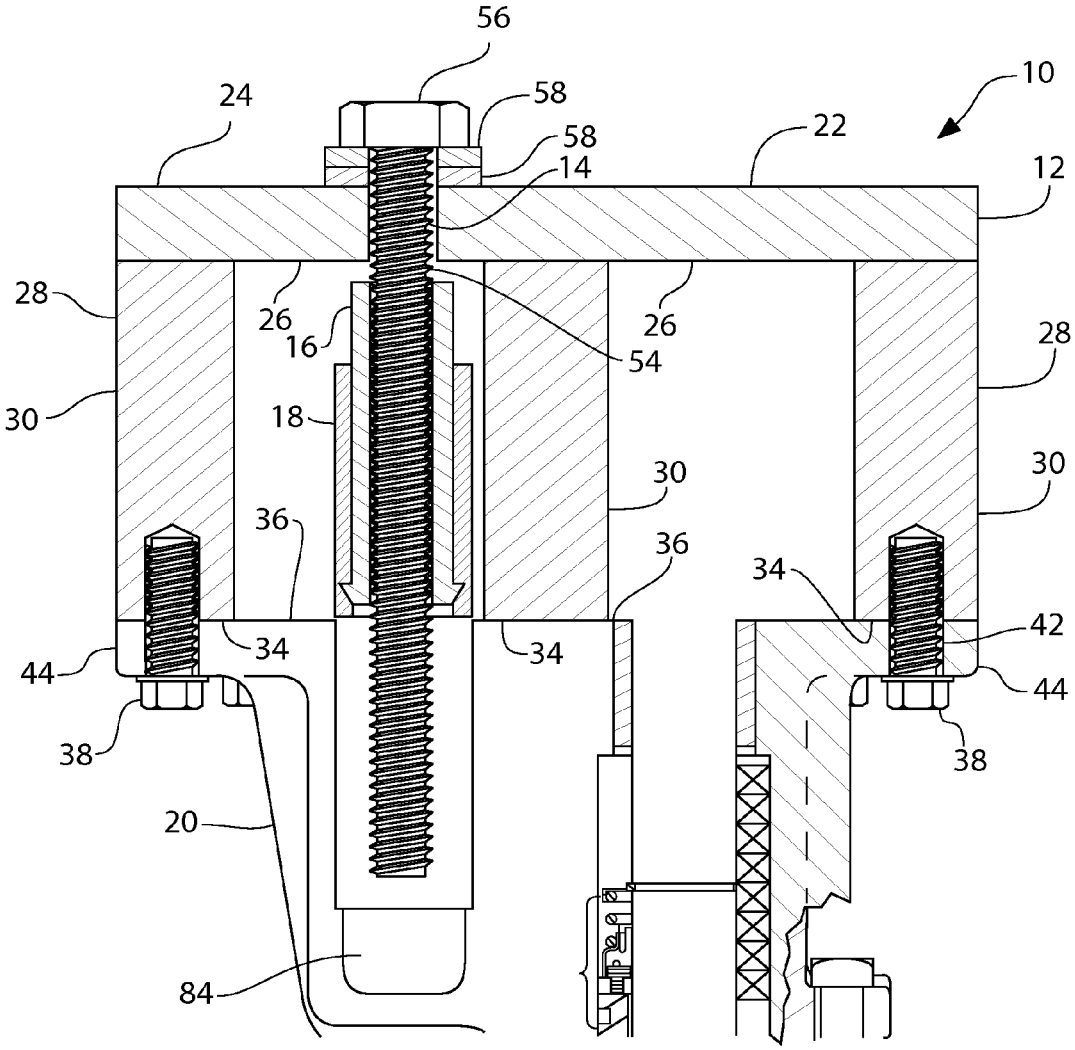
FIG. 3 is a side sectional view of the extractor tool of FIG. 1 after removal of the bearing or bushing sleeve.

FIGS. 1-3 depict an exemplary extractor tool 10 in accordance with the preferred embodiments, with FIGS. 1 and 3 in cross sectional view. The tool 10 includes a mounting bracket 12, a lift screw 14, and a collet 16. The extractor tool 10 is shown in FIGS. 1 and 2 with the collet 16 within a bushing or bearing sleeve 18 that is inserted in a housing 20. Unless otherwise stated, each component discussed herein is made from material as needed for the purpose and application of the specific component, as would be readily understood by a skilled artisan The mounting bracket 12 includes a central bridge member 22 with a top exterior face 24 and an interior face 26. Integral with the central bridge member 22, the mounting bracket 12 also includes a depending member 28 having wall portions 30 extending from the interior face 26 of the central bridge member a first distance 32 towards a distal housing engaging surface 34 opposite the top exterior face 24. As can be seen in FIG. 1, during use for extracting sleeve 18 out of the housing 20, the housing engaging surface 34 preferably abuts and opposing top surface 36 of the housing 20. A mounting fastener such as a bolt 38 may fixedly secure the mounting bracket 12 to the housing 20 via, for example, a threaded engagement between the bolt and a complimentary threaded opening 40 of the depending member 28 through an aligned aperture 42 in a flange 44 of the housing 20.

The wall portions 30 of the depending member 28 and the interior face 26 of the central bridge member 22 define a sleeve receiving channel 46 within the mounting bracket 12. As can best be seen in FIG. 2, the wall portions 30 may be a plurality of legs extending between the central bridge member 22 and the housing engaging surface 34. It is also contemplated that that wall portions 30 may have other configurations, for example with the wall portions 30 adjacent the lift screw 14 being part of a common cylindrical unit.

Referring to FIGS. 1-3, the central bridge member 22 includes a bore 48 extending therethrough (FIGS. 1 and 3) with openings at both the top exterior face 24 and interior face 26. During use, the bore 48 preferable is in axial alignment with the sleeve 18. The sleeve 18 is shown having a central recess 50 defining a radial surface 52. The mounting bracket 12 supports the lift screw 14 and accepts rotational and axial movement through the bore 48 for alignment and passage of the lift screw 14 into the sleeve receiving channel 50, as will be described in greater detail below. While not being limited to a particular theory, the bore 48 is preferably not threaded to allow unrestricted rotation and axial shifting of the lift screw 14 through the bore. However, it is contemplated that the bore 48 may be threaded to match the threaded lift screw 14.

The lift screw 14 includes a threaded shaft 54 fixedly attached to a screwhead 56 or to an alternative torque engaging member as would readily be understood by a skilled artisan. The screwhead 56 is an exemplary torque engaging member having a hexagonal column shape as a hex head bolt. The screwhead 56 may have an alternative shape such as, for example, a conventional cap screw or a hex recess that may be turned by the use of an Allen wrench into the hex recess of the torque engaging member. The torque engaging member is continuous with the threaded shaft 54 and has a diameter preferably larger than the diameter of the shaft 54 and larger than the opening of the bore 48. In this configuration, the bore 48 allows passage of the threaded shaft 54 therethrough and inhibits or blocks the screwhead 56 from passing through the bore. Accordingly, as can be seen in FIG. 2, the screwhead is attached to and continuous with the threaded shaft 54 preferably adjacent the top exterior face 24 of the central bridge member 22. A wear reducing member, such as a first washer 58, is shown engaged about the shaft 54 between the screwhead and the top exterior face 24 of the central bridge member to reduce frictional wear between the screwhead and the top exterior face. Such frictional wear is further reduced by the addition of another washer 58 adjacent the first washer.

As illustrated in FIGS. 1-3, the threaded shaft 54 includes a shaft body 80 with a helical screw thread 82. The shaft body 80 has a uniform diameter with the helical thread formed around an outer surface of the shaft body. The threaded shaft 54 is longer than the first distance 32, to allow the shaft to extend through the bore 48 of the central bridge member 22 into the housing 20 within the central recess of the sleeve 18.

The collet 16 is a sleeve engaging member adapted for easy insertion into the sleeve 18 and for gripping and holding onto the sleeve 18 during its removal from the housing 20. The collet 16 is preferably somewhat cylindrical but is not limited to a cylindrical shape. In particular, the collet integrally has an exterior wall 60 and an interior wall 62, with the interior wall threaded with a thread size complimentary to the threaded shaft 54 of the lift screw 14. The collet 16 has a proximal end 64 and a distal end 66, with the radius of curvature at the distal end less than that of the proximal end. In other words, the interior wall 62 of the collet 66 has a tapered shape with a diameter smaller as the distal end than at the proximal end (FIG. 2). The radius of curvature and smaller diameter at the distal end 66 allows the collet 16 to be inserted into this sleeve 18, for example, by simply sliding the collet into the central recess 50 of the sleeve.

Figure 4:
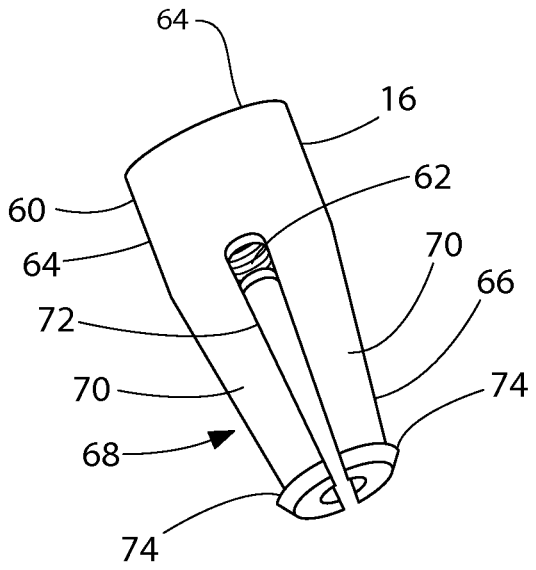
FIG. 4 is a perspective view of an exemplary collect.

FIG. 4 depicts the collet 16 in perspective view. Referring to FIGS. 1-4, the distal end 66 of the collet 16 includes a grasping portion 68 arranged to grip the radial surface 52 of the sleeve 18 during extraction of the sleeve. The grasping portion 68 includes a plurality of grasping members 70, each defined by a longitudinal slot 72. The grasping members 70 are pulling members preferably substantially identical in shape, with each being elongated continuous from the proximal end 64 of the collet 16, and threaded along the interior wall 62. Each grasping member 70 is tapered radially inwards towards the distal end 66 to allow for the grasping members to slide within the sleeve 18 into the central recess 50 thereof, as can best be seen in FIGS. 1 and 2.

While not being limited to a particular theory, the grasping members 70 are provided at the distal end 66 with outwardly extending flanges or tabs 74 which fit within the central recess 50 engageable with a shoulder 76 of the sleeve, defined by a notch thereof, upon radial expansion of the grasping members. As discussed above, the interior wall 62 of the collet 16 is tapered toward the distal end 66 with a diameter smaller than at the proximal end 64 so that sufficient clearance is provided between the grasping members 70 and the radial surface 52 of the sleeve 18 to permit the grasping members to be positioned in the central recess 50 of the sleeve with the tabs 74 located at or near the shoulder 76 (FIG. 2). Upon radial expansion of the grasping members 70, as provided for example by threading of the lift screw 14 into the distal end 66, the grasping members 70 engage and hold against the interior wall 62, preferably with the tabs 74 extended into the notch 78 under the shoulder 76.

Figure 5:
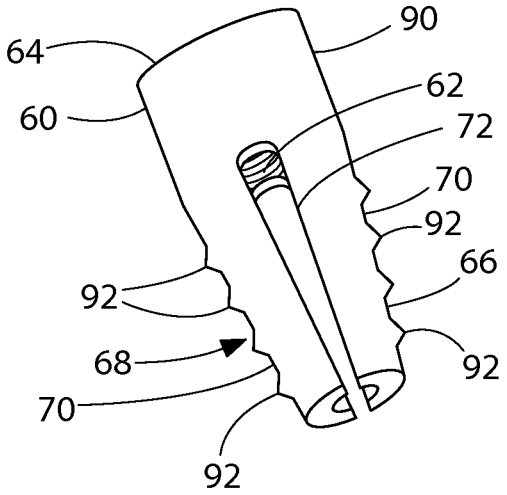
FIG. 5 is a perspective view of another exemplary collet.

FIG. 5 depicts another exemplary collet 90 in accordance with the preferred embodiments. The collet 90 is similar to the collet 16, and includes raised projections 92 in lieu of tabs 74 to help bind the collet 90 and the sleeve 18 for extraction of the sleeve. It is understood that the projections 92 may include ridges, bumps and other raised members adaptable to secure the collet 90 to the sleeve 18 and form a locking engagement therebetween during removal of the sleeve from the housing 20.

Figure 6:
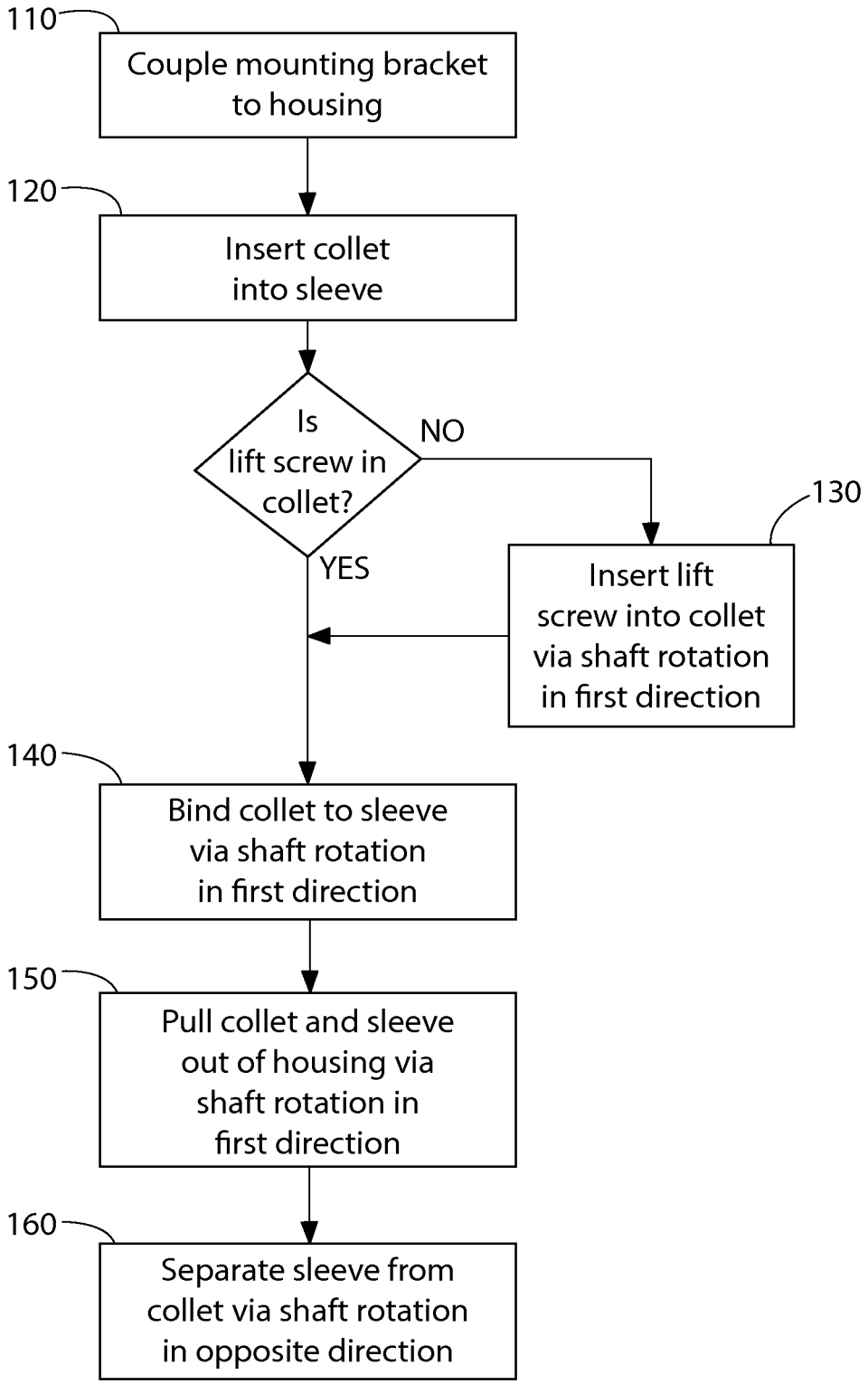
FIG. 6 is a full chart illustrating exemplary procedures for removing a bearing or bushing sleeve from a housing.

FIG. 6 is a flow chart of an exemplary method for pulling out the sleeve inserted into the housing with the extractor tool 10. As can be seen in FIGS. 1-3, and further discussed with reference to FIG. 6, the lift screw 14 is continuously rotatable in a first arcuate direction, for example, clockwise relative to the collet 16 to engage the collet, to bind the collet to the sleeve 18, and to extract the sleeve 18 from the housing 20. Initially the mounting bracket 12 is coupled to the housing 20 at step 110. This coupling provides support for the pulling action exerted on the collet and sleeve 18 during extraction. In addition, the mounting bracket 12 may be secured to the housing 20, for example, with bolts 38 threaded through apertures 42 in the flange 44 of the housing and into wall portions 30 of the mounting bracket. At step 120, the collet 16 is disposed into the sleeve 18, for example, by dropping or sliding the collet into the sleeve. It is understood that the collet 16 may be disposed into the sleeve 18 before the collet's engagement with the lift screw 14 or after engagement with the lift screw with the shaft body 64 of the lift screw in the proximal end of the collet. With a clockwise rotation of the screwhead 56, the lift screw 14 threads into and engages the collet 16 at its proximal end 64 (FIG. 1) at step 130.

It should be noted that the invention is not limited to the order of steps 110, 120 and 130. In other words, it is understood that these steps of coupling the mounting bracket to the housing, inserting the collet into the sleeve, and inserting the lift screw into the collet may be carried out in any order within the scope of the invention, as would readily be understood by a skilled artisan.

After engagement of the lift screw 14 with the collet 16, and the disposal of the collet into the sleeve 18, the screwhead 56 may be further torqued and rotated in the same first direction (e.g., clockwise) to move the shaft body 80 into the distal end 66 of the collet (FIG. 2) at step 140. This rotation of the lift screw 14 towards the distal end 66 pushes the gripping members 70 radially outward, and radially expands the exterior wall 60 at the distal end into a gripping binding engagement with the radial surface 52 of the sleeve 18. Preferably, as the shaft body 80 enters the distal end 66, due to its size, the shaft body pushes the grasping members 68 outwards so that the tabs 74 extend into the notch 78 of the sleeve 18 under the shoulder 72 (FIG. 2) to establish a gripping connection between the collet 16 and the sleeve 18.

To pull the sleeve 18 and collet 16 out of the housing 20, at step 150 the lift screw 14 is further rotated in the first direction (e.g., clockwise) against the collet which is locked against the sleeve so as to feed the lift screw further through the collet. With the screwhead 56 abutting the central bridge member 22 (possibly with washers 58 therebetween), this rotation of the lift screw 14 pulls the collet upwards towards the screwhead 56. Since the collet 16 and sleeve 18 coupled with the tabs 74 positioned behind the shoulder 76 of the sleeve to help maintain the frictional lock between the exterior wall 60 of the grasping member 68 and the radial surface 52 of the collet 16, shifting the collet towards the screwhead and central bridge member 22 also shifts and extracts the sleeve from the bore 84 of the housing 20 as can be seen in FIG. 3. Preferably the first distance 32 is greater than the length of the collet 16 and sleeve 18 when the collet and sleeve are coupled during extraction, to permit complete extraction of the sleeve 18 while the mounting bracket 12 is coupled to the housing 20.

It should be noted that with the preferred examples, the lift screw 14 does not need to engage or push against the housing 20 below the bore 84, which thus minimizes wear on the lift screw and housing. Instead, the sleeve 18 is extracted from the bore 84 with engagement between the lift screw 14, the collet 16, with the extraction of the sleeve from the housing 20 accomplished by rotating the lift screw 14 in the first direction.

After the sleeve 18 is extracted from the housing 20, the sleeve and collet 16 may be separated at step 160 by gripping the sleeve manually or with a gripping tool, and rotating the lift screw in a second direction opposite the first direction (e.g., counter-clockwise) to withdraw the lift screw 14 from the distal end 66 of the collet. This withdrawal allows the grasping members 70 to return to their tapered configuration and release their lock against the radial surface 16 of the collet. With a gap reestablished between the collet 16 and sleeve 18, the two may easily slide apart.

Preferably, and for efficiency, the engagement of the collet 16 and the sleeve 18, and the extraction of the sleeve may be accomplished by continuous non-stopping rotation of the lift screw in the first direction. Further, if the collect 16 is initially disposed within the sleeve 18 before engagement with the lift screw 14, then a continuous and non-stopping (i.e., perpetual) rotation of the lift screw in the first direction most efficiently may accomplish the steps of engaging the collet and the lift screw with the lift screw rotating into the interior wall 62 of the collet, radially expanding the grasping members 70 into gripping engagement with the radial surface 52 of the sleeve, and pulling the sleeve out of the housing 20, all by rotating the lift screw in only the first direction.

While the invention has been described in detail and with reference to specific examples thereof, it will be apparent to one skilled in the art that various changes and modifications can be made therein without departing from the spirit and scope thereof. In other words, the concept of the present invention may be readily applied to a variety of embodiments, including those disclosed herein. For example, it is understood that the invention is not limited to a number of washers or to a bolted connection between the extractor tool and the housing. Without further elaboration, the foregoing will so fully illustrate the invention that others may, by applying current future knowledge; readily adapt the same for use under various conditions of service.

What is claimed is:

1. An extractor tool for pulling a sleeve out of a housing, the sleeve having a central recess defining a radial surface, the extractor tool comprising:

a mounting bracket including a central bridge member with a top face and a depending member integral with the central bridge member and extending therefrom a first distance towards a distal housing engaging surface thereof opposite the top face to contact a surface of the housing outside the sleeve, the depending member and the central bridge member defining a sleeve receiving channel within the mounting bracket, the central bridge member having a bore therethrough in alignment with the sleeve receiving channel;

a lift screw including a shaft having an exterior threaded surface, the lift screw extending through the bore in the mounting bracket; and a sleeve engaging member continuous with the shaft and slidingly engageable within the central recess of the sleeve, the sleeve engaging member having a proximal end and a distal end, the sleeve engaging member integrally having an exterior wall and an interior bore extending therethrough, the bore having an internally threaded tapered surface with a thread sized complementarily to the exterior threaded surface of the shaft of the lift screw, the internally threaded tapered surface of the interior bore having a diameter smaller at the distal end of the sleeve engaging member than at the proximal end thereof, the distal end including a grasping portion with a plurality of longitudinal slots dividing the grasping portion into a plurality of grasping members, each grasping member being radially expandable upon the rotation of the shaft towards the distal end to cause the exterior wall to engage the radial surface of the sleeve, the lift screw being rotatable in a first rotatable direction relative to the sleeve engaging member to cause the exterior threaded surface of the shaft to engage the internally threaded tapered surface of the interior bore to cause the exterior wall of the sleeve engaging member to radially expand and grip the radial surface of the sleeve, and to pull the sleeve out of the housing.

2. The extractor tool of claim 1, the lift screw further including a screwhead attached to the shaft at a adjacent the top face of the central bridge, the extractor tool further comprising a wear reducing member engaged about the shaft of the lift screw between the screwhead and the top face of the central bridge member.

3. The extractor tool of claim 1, further comprising a mounting fastener fixedly securing the mounting bracket to the housing.

4. The extractor tool of claim 1, wherein said depending member includes a plurality of legs.

5. The extractor tool of claim 1, wherein said lift screw shaft is longer than the first distance of the depending member and is adapted to extend from said central bridge member through the sleeve receiving channel into the central recess of the sleeve.

6. The extractor tool of claim 1, wherein the bore in the mounting bracket is configured to allow free rotation of the shaft regardless of the thread of the shaft.

7. The extractor tool of claim 1, the grasping portion of the sleeve engagement member further comprising tabs at the exterior wall extending radially outward for locked engagement with the sleeve.

8. The extractor tool of claim 1, wherein the lift screw is rotatable in a second rotational direction opposite the first rotational direction to separate the gripping members from the radial surface of the sleeve.

9. The extractor tool of claim 1, wherein the lift screw is perpetually rotatable in the first rotational direction relative to the sleeve engaging member to engage the sleeve engaging member, to cause the exterior wall of the sleeve engaging member to radially expand and grip the radial surface of the sleeve, and to pull the sleeve out of the housing.

* * * * *